US008961378B2

(12) United States Patent
Holland

(10) Patent No.: US 8,961,378 B2
(45) Date of Patent: Feb. 24, 2015

(54) ELASTIC RESISTANCE CORD TRAINING SYSTEM AND HANDLES

(75) Inventor: Allen Holland, Sheffield (GB)

(73) Assignee: Pro Performance Sports, L.L.C., Carlsbad, CA (US)

( * ) Notice: Subject to any disclaimer, the term of this patent is extended or adjusted under 35 U.S.C. 154(b) by 242 days.

(21) Appl. No.: 13/460,137

(22) Filed: Apr. 30, 2012

(65) Prior Publication Data

US 2013/0288864 A1 Oct. 31, 2013

(51) Int. Cl.
*A63B 21/02* (2006.01)
*A63B 71/00* (2006.01)

(52) U.S. Cl.
USPC ..... 482/126; 482/121; 482/139

(58) Field of Classification Search
USPC ..... 482/81–82, 92, 121–126, 129–130, 139
See application file for complete search history.

(56) References Cited

U.S. PATENT DOCUMENTS

| | | | | |
|---|---|---|---|---|
| 1,194,793 | A * | 8/1916 | Styers | 285/376 |
| 3,427,023 | A * | 2/1969 | Silberman | 482/139 |
| 3,528,656 | A * | 9/1970 | Haanen | 482/139 |
| 3,873,088 | A * | 3/1975 | Panepinto | 482/126 |
| 4,195,835 | A | 4/1980 | Hinds et al. | |
| 4,762,318 | A | 8/1988 | Phillips et al. | |
| 4,779,867 | A | 10/1988 | Hinds | |
| 5,277,683 | A * | 1/1994 | Wilkins | 482/129 |
| 5,624,360 | A * | 4/1997 | Wilkins | 482/129 |
| 5,665,040 | A * | 9/1997 | Ho | 482/126 |
| 6,151,758 | A * | 11/2000 | Chiu | 16/443 |
| 6,497,641 | B1 | 12/2002 | Hinds | |
| 6,676,576 | B1 * | 1/2004 | Wu | 482/126 |
| 6,923,750 | B1 | 8/2005 | Hinds | |
| 6,988,978 | B1 | 1/2006 | Nault et al. | |
| 7,377,886 | B2 * | 5/2008 | Wu | 482/126 |
| 7,628,735 | B1 * | 12/2009 | Hsu | 482/82 |
| 7,798,945 | B2 * | 9/2010 | Ko | 482/126 |
| 7,914,426 | B1 * | 3/2011 | Lie | 482/126 |
| 8,475,345 | B2 * | 7/2013 | Wang | 482/122 |
| 2009/0253562 | A1 * | 10/2009 | Yang | 482/126 |
| 2010/0240505 | A1 * | 9/2010 | Yang | 482/126 |

FOREIGN PATENT DOCUMENTS

| | | | | |
|---|---|---|---|---|
| CH | 633721 | A * | 12/1982 | A63B 21/02 |

OTHER PUBLICATIONS

International Searching Authority, International Search Report and Written Opinion issued in PCT International Application No. PCT/US2013/038510 dated Aug. 15, 2013.

* cited by examiner

*Primary Examiner* — Loan H Thanh
*Assistant Examiner* — Garrett Atkinson
(74) *Attorney, Agent, or Firm* — Kenneth H. Ohriner; Perkins Coie LLP

(57) ABSTRACT

A handle for an elastic resistance cord training system includes a grip on a handle frame adjacent to a first end of the handle frame. A base is provided on the handle frame adjacent to a second end of the handle frame, with the base having one or more one cord channels. A gate is movable or slidable on the handle frame from an open position where the gate is substantially spaced apart from the cord channel, to a closed position wherein the gate overlies the cord channel. With the gate in the open position, the cords can be quickly and easily swapped out.

10 Claims, 13 Drawing Sheets

FIG. 7
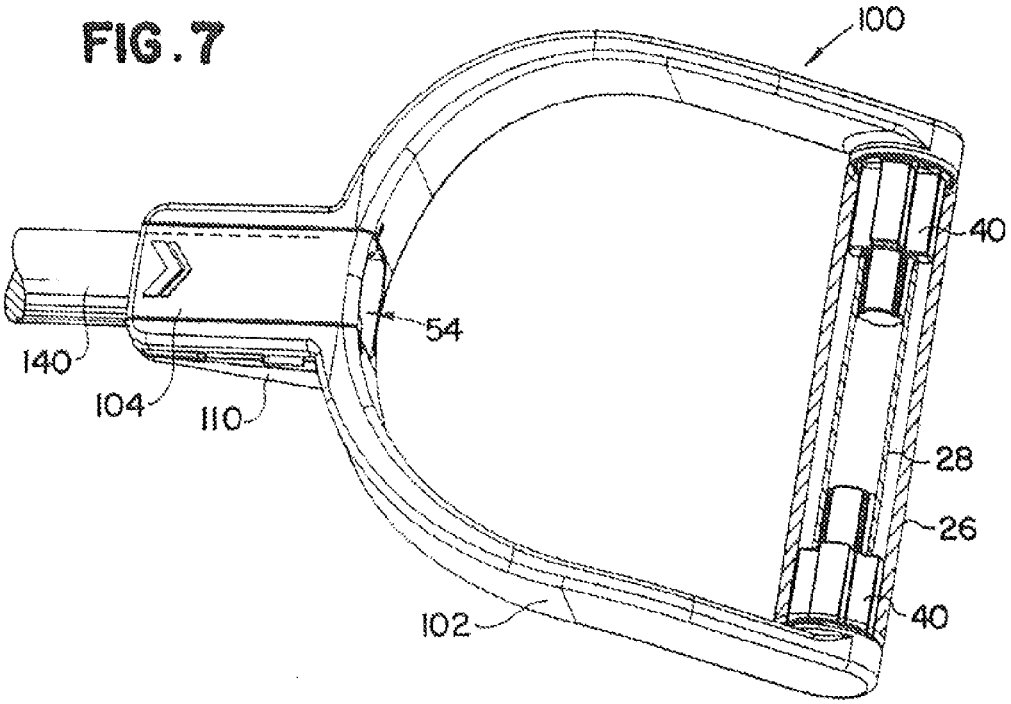
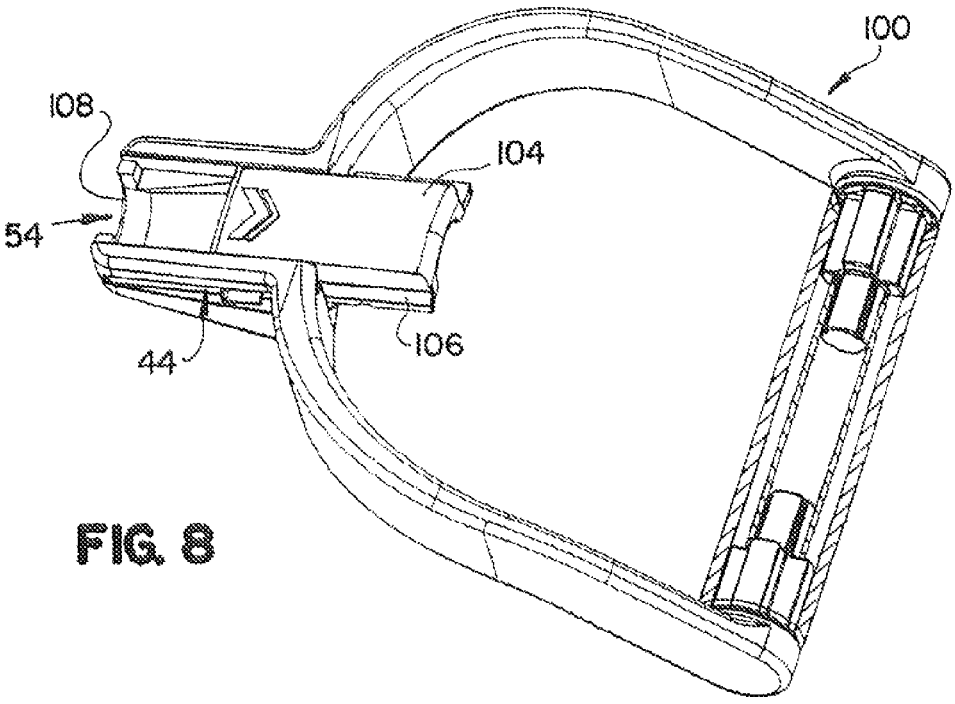
FIG. 8

FIG. 9
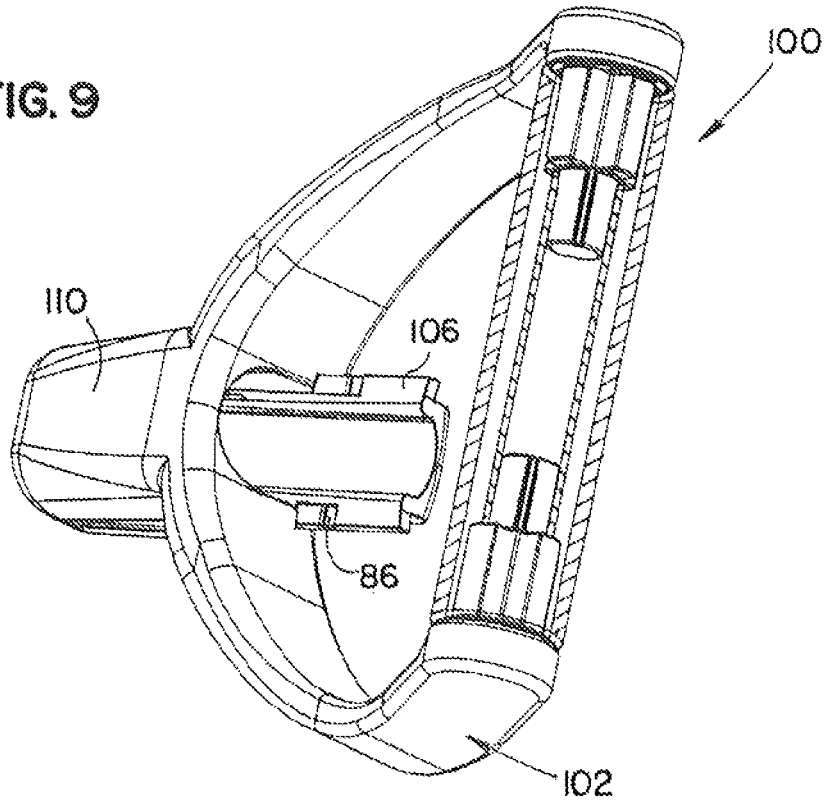
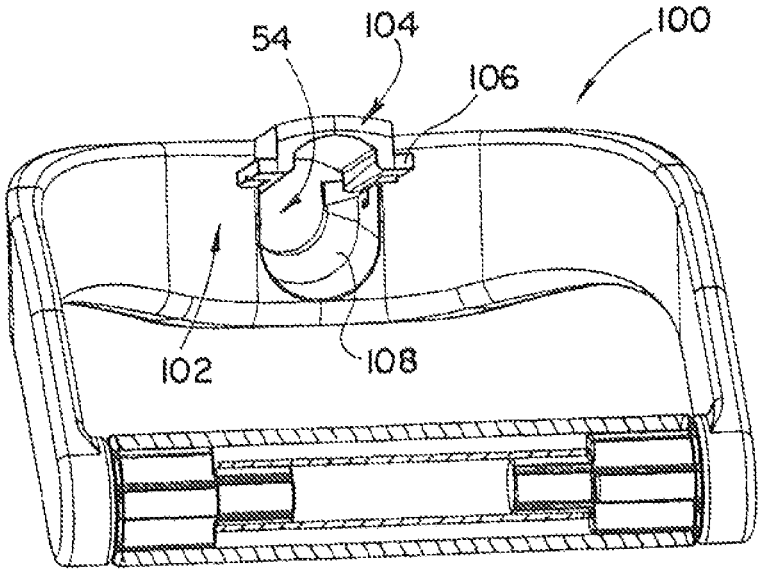
FIG. 10

FIG. 11
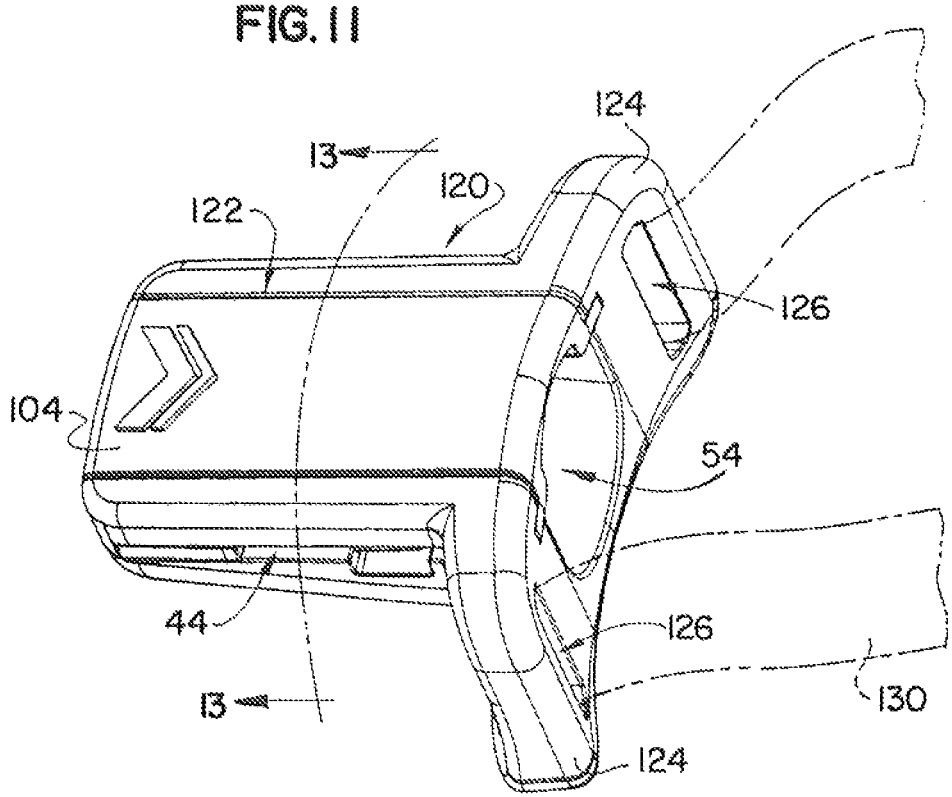
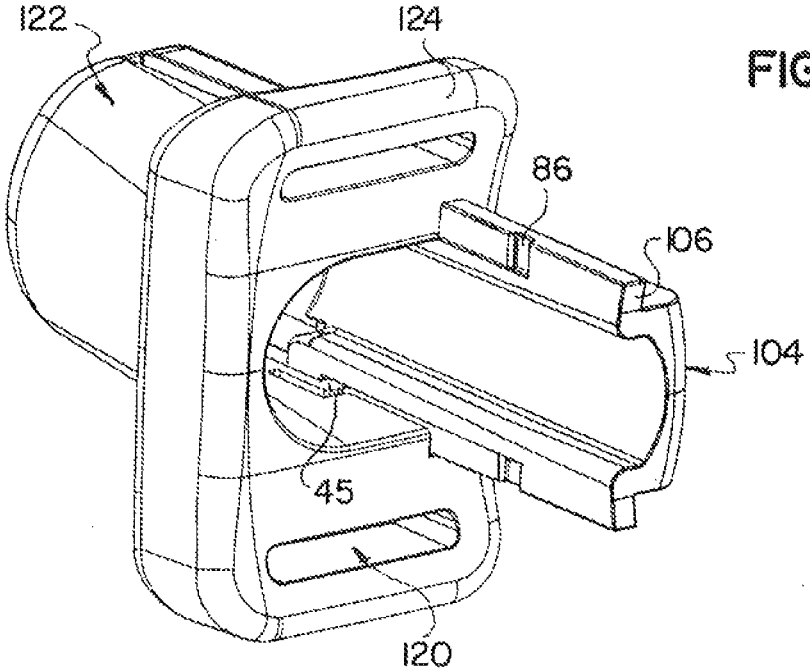
FIG. 12

ELASTIC RESISTANCE CORD TRAINING SYSTEM AND HANDLES

BACKGROUND OF THE INVENTION

The field of the invention is elastic resistance cord handles and training systems. Elastic resistance cord training systems are widely used for athletic training, as well as for physical exercise more generally. These devices or systems have handles attached to one or more elastic cords. The handles may be rigid handles, typically made of molded plastic, or the handles may be flexible strap-type of handles typically made of Nylon, canvas, or a similar fabric or braided material. The handles are designed to be gripped by the user's hand, and/or placed over the user's foot, or a fixed object.

More widely used elastic resistance cord training systems allow the number and type of cords to be quickly changed. This allows the user to quickly and easily adjust the desired resistance of the system. The engineering challenge in handle design is to provide a handle that allows quick and easy cord removal and installation, but that also securely attaches the end of the cord to the handle when the system is in use.

SUMMARY OF THE INVENTION

In a first aspect, a handle for an elastic resistance cord training system includes a grip on a handle frame adjacent to a first end of the handle frame. A base is provided on the handle frame adjacent to a second end of the handle frame, with the base having one or more one cord channels. A gate is movable or slidable on the handle frame from an open position where the gate is substantially spaced apart from the cord channel, to a closed position wherein the gate overlies the cord channel.

In a second aspect, the gate has left and right side arms extending into left and right side gate slots in the handle frame. The gate may also have a cord groove aligned with each of the cord channels. The base may optionally have a divider between each of the cord channels, and a shoulder on an inside surface of the gate aligned over each divider.

In a third aspect, a detent arm on the handle frame is engageable into a recess in the gate.

Other and further aspects and advantages are described in the following detailed description, which is provided by way of example and explanation, and which is not intended to imply limits on the scope of the invention. The invention resides as well in methods of use as described below, and also in sub-combinations of the elements described.

BRIEF DESCRIPTION OF THE DRAWINGS

In the drawings, the same element number indicates the same element in each of the views:

FIG. 7 is a front perspective view of a second embodiment of a handle for an elastic resistance cord training system, with a gate on the handle in a closed position.

FIG. 8 is a front perspective view of the handle of FIG. 7 with the gate now in an open position.

FIG. 9 is rear perspective view of the handle as shown in FIG. 8.

FIG. 10 is a top perspective view of the handle as shown in FIGS. 8 and 9.

FIG. 11 is a front perspective view of a third embodiment of a handle for an elastic resistance cord training system, with a gate on the handle in a closed position.

FIG. 12 is a top perspective view of the frame shown in FIG. 11, with the gate now in the open position, and the strap omitted for purpose of illustration.

DETAILED DESCRIPTION

Figure 1:
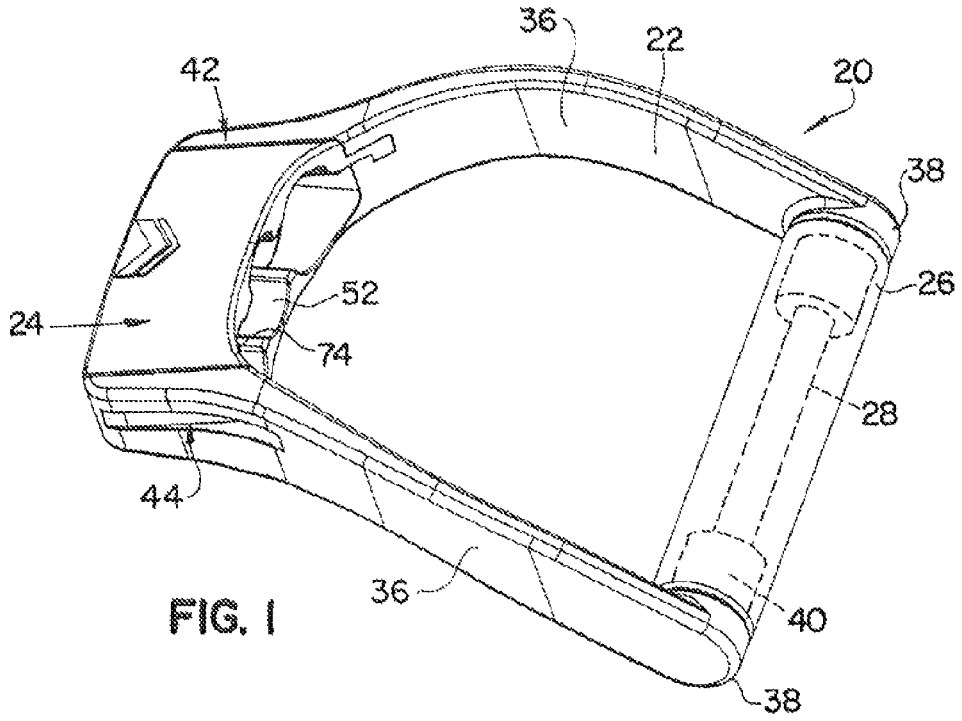
FIG. 1 is a front perspective view of a handle for an elastic resistance cord training system, with a gate on the handle in a closed position.
Figure 2:
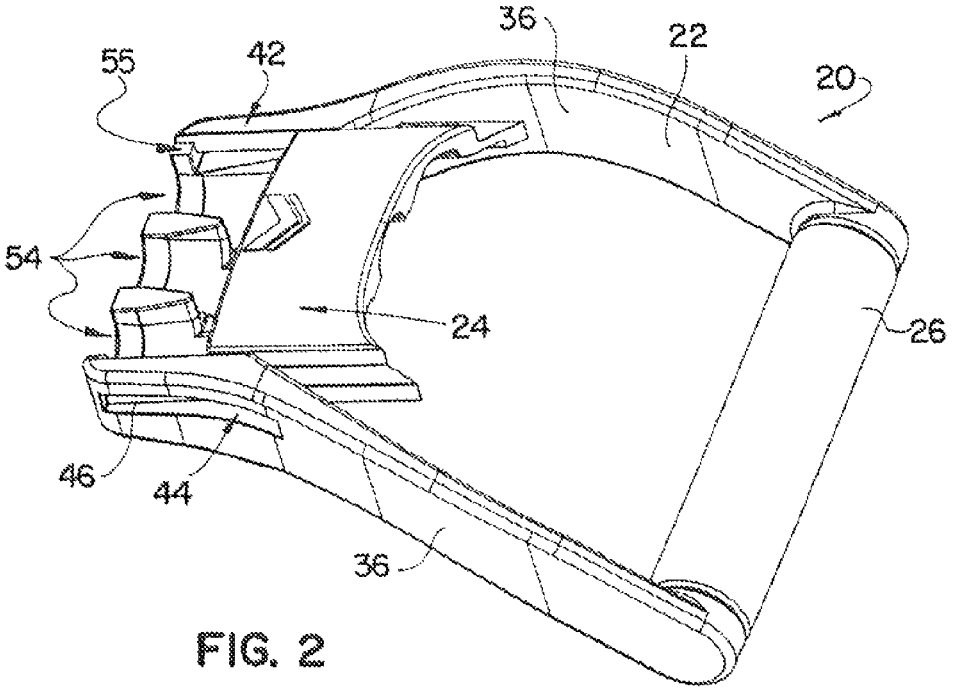
FIG. 2 is a front perspective view of the handle of FIG. 1 with the gate now in an open position.

Turning now in detail to the drawings, as shown in FIGS. 1-2, a handle 20 for an elastic resistance training system has a gate 24 moveable on a frame 22. The frame has first and second spaced apart arms 36 attached onto opposite sides of a base section 42. The outer or free ends of the arms 36 may have rounded ends 38. A grip, such as a roller 26 is attached to the arms 36. This attachment may be achieved via an axle 28 extending between axle stubs 40 on the outer ends of the arms 36 extending inwardly towards each other, with the roller 26 supported on the axle 28 and/or the axle stubs 40. The roller 26 may be rotatably attached to the frame 22 in this design.

Figure 3:
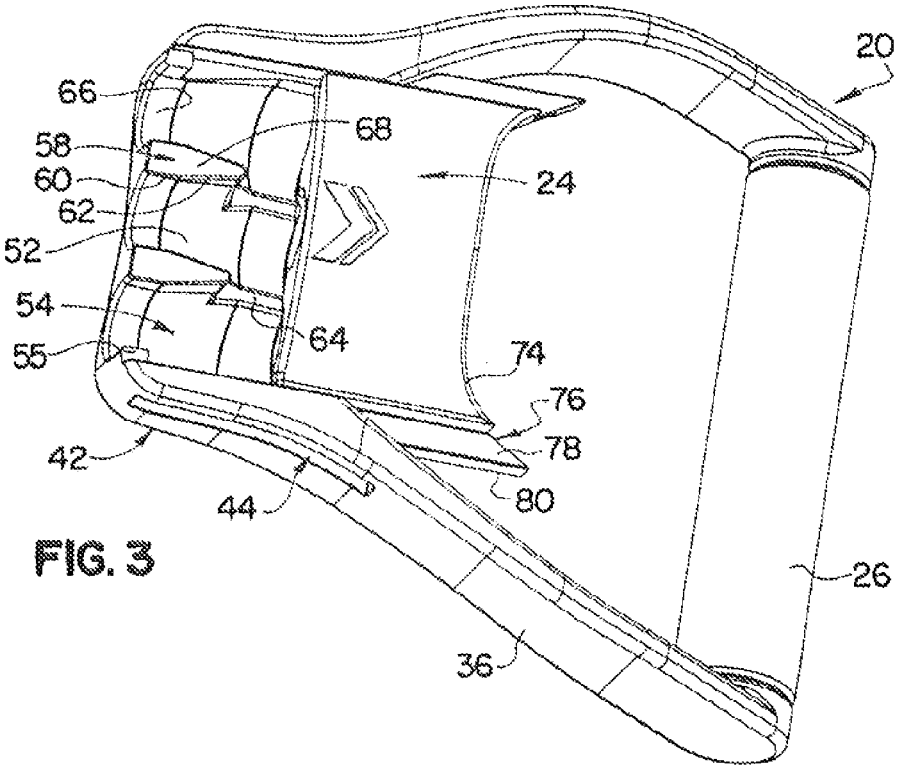
FIG. 3 is an enlarged front perspective view of the handle as shown in FIG. 2.

Referring to FIGS. 2 and 3, one or more cord channels or positions 54 are provided in the base section 42. FIGS. 1-6 show an example having three cord channels. Other designs may have one, two, four, five, six or more cord channels. As shown in FIG. 3, a divider 58 separates adjacent the cord channels 54. The divider 58 may have lower straight wall cylindrical section 60 leading into a tapered section 62, for example, a conically tapered section. The inner surface 52 of the base section 42 between the dividers 68, may also have a conical taper. The outer or rear wall 56 of the base section 42 may have a slight curvature, optionally matching the curvature of the top or outer surface 70 of the gate 24. The divider 58 may also have a flat top surface 68. Turning momentarily to FIG. 6, a divider extension 64 may extend from the divider 58 to the top edge of the base section 42.

Figure 4:
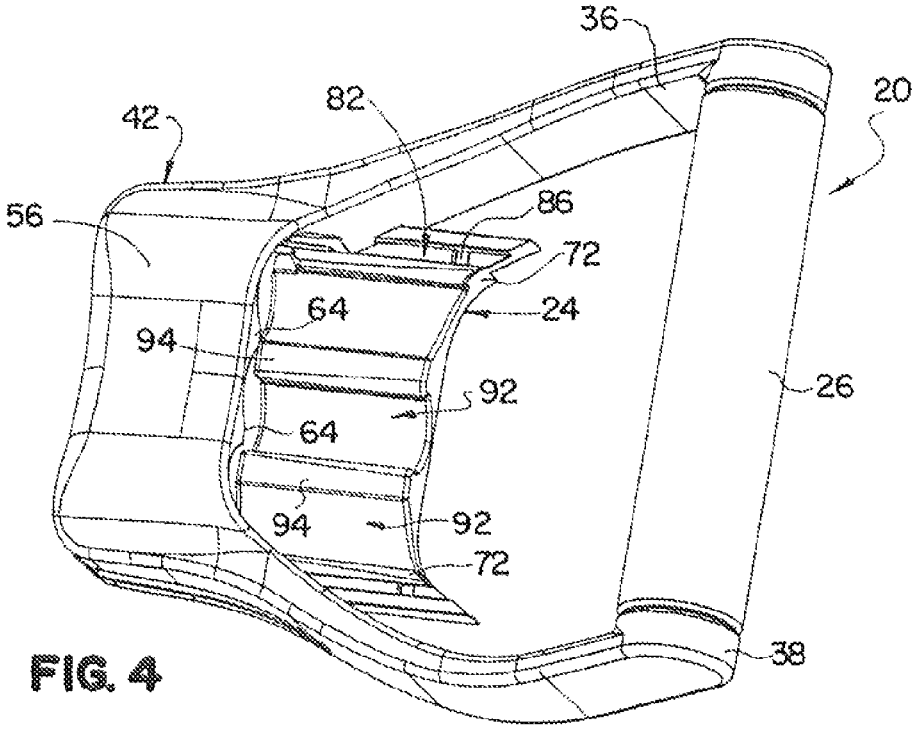
FIG. 4 is rear perspective view of the handle as shown in FIGS. 2 and 3.
Figure 5:
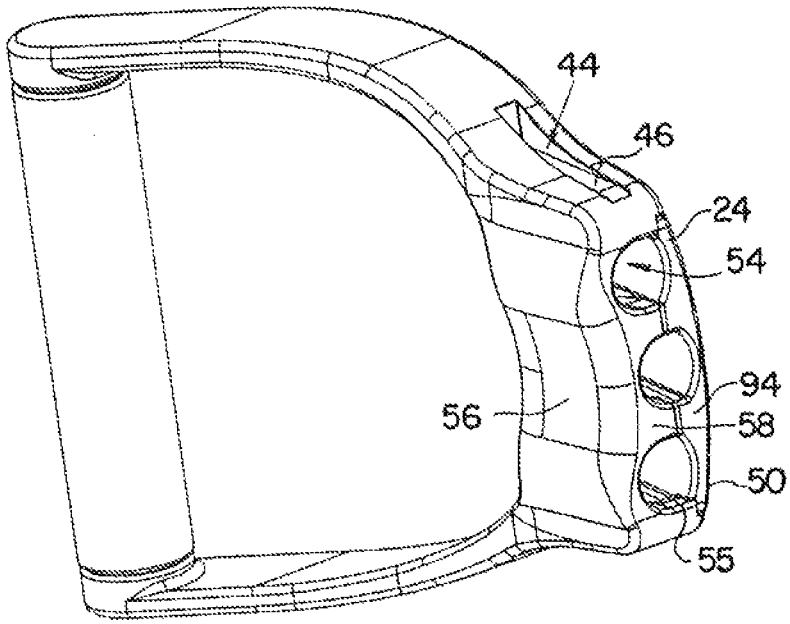
FIG. 5 is a perspective bottom end view of the handle as shown in FIG. 1.
Figure 6:
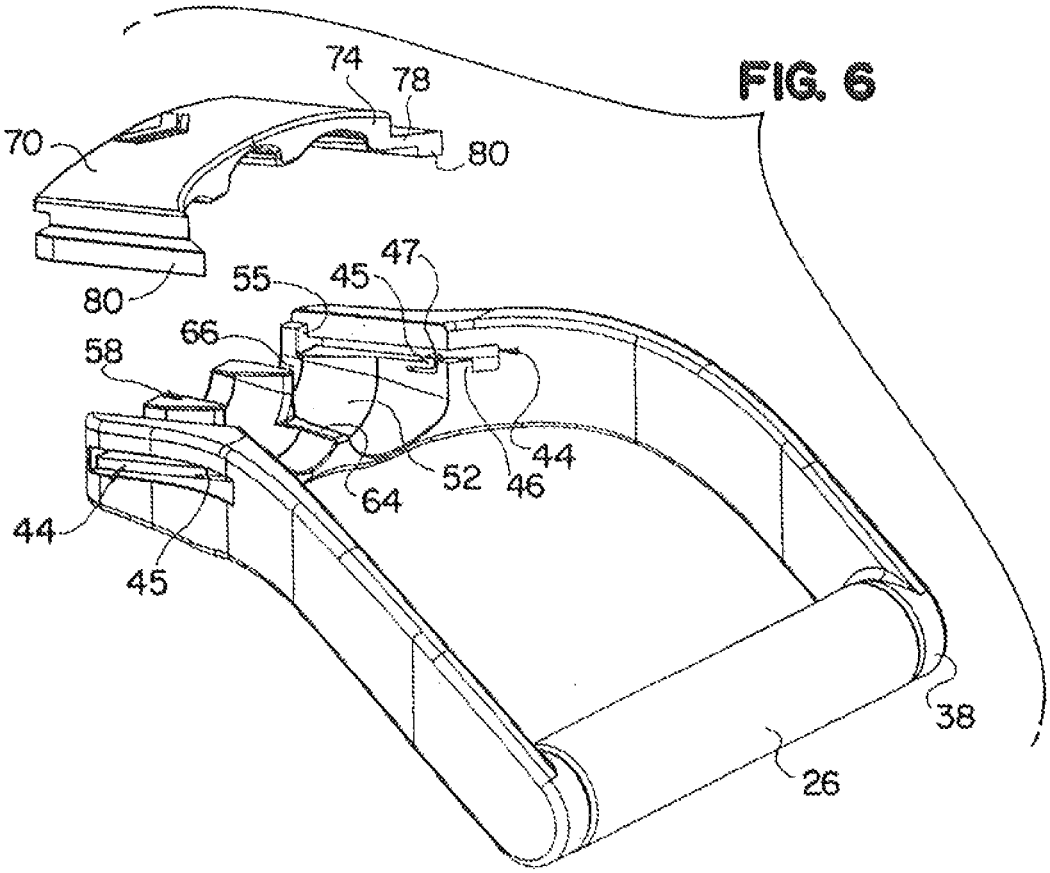
FIG. 6 is an exploded top and side perspective view of the handle shown in FIGS. 1 and 2.
Figure 13:
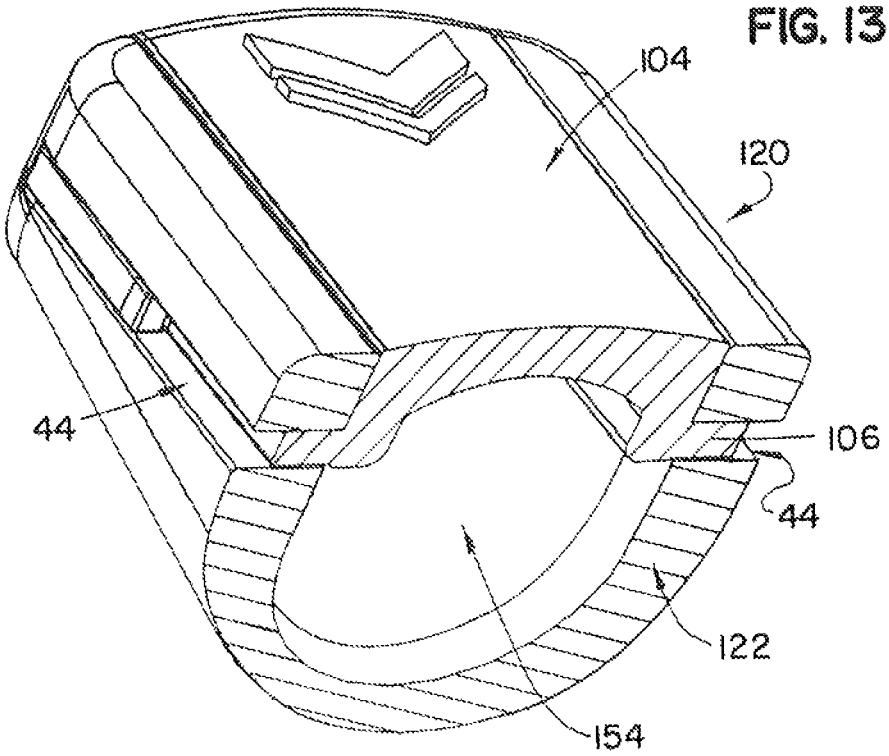
FIG. 13 is perspective section view taken along line 13-13 of FIG. 12.
Figure 14:
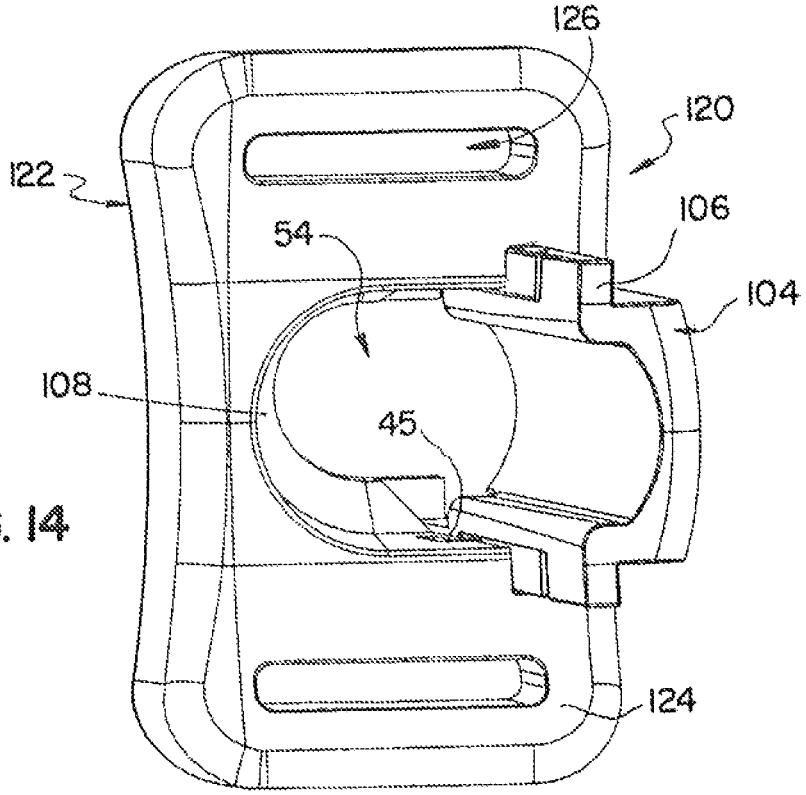
FIG. 14 is a top perspective view of the frame as shown in FIG. 12.

The gate has features that allow it to slide from the closed position shown in FIGS. 1 and 5 to the open position shown in FIGS. 2-4. Various sliding features may be used. In the example shown, the gate has gate arms 76 that extend into gate slots 44 on opposite sides of the base section 42. Referring to FIG. 4, each gate arm 76 may have a lateral section 78 joined to a vertical section 80, with a groove 82 on an inner surface of the lateral section 78. A block opening or hole 86 may be provided in the groove 82 adjacent to the top end of the gate 24. A detent block 47 on the end of a detent arm 45 formed in, or attached onto, a slot wall 46 in the gate slot 44 is adapted to spring outwardly into the block opening 86 in the gate, to secure the gate 24 into an open position, and into a closed position. As shown in FIGS. 4-6, the gate may have cord grooves 92 separated by cord shoulders 94 on the bottom or inner surface.

FIGS. 7-10 show a second handle design 100 having a single cord channel 54, in contrast to the three code channels 54 of the handle 20 shown in FIGS. 1-6. The handle 100 is similar to the handle 20 and has a frame 102, and a gate 104 having a gate arm 106. In this design, the gate arm 106 is a tab or ledge extending outwardly on the gate, in contrast to the Z or L-shaped gate arm 76 in FIGS. 1-6. A lip 108 may be provided at the bottom or outer end of the cord channel 54. The handle 100 has a narrow base section 110 as it holds a single cord.

FIGS. 11-14 show another handle 120 having a frame 122 adapted for use with flexible straps or handle loops 130. The frame 122 has strap slots 126 to allow the straps 130 to be securely attached to the frame 122. The ends of the straps 130 may be threaded through the strap slots 126 and then stitched, riveted, knotted, or otherwise attached to the straps, to substantially permanently attach the straps to the frame. Alternatively, a single strap may be threaded up through one slot, cross the frame 122 (with the strap behind the gate 104), and down through the second slot. The free ends of strap may then be attached to each other, optionally through a strap length adjuster, or strap end attachment devices, such as various types of buckles, quick release clips, etc. This allows the length of the strap to be adjusted, and also allows the strap 130 to be easily and securely attached to a fixed object.

FIG. 7 shows a cord 140 secured into a handle 100. The cord 140 is typically a hollow elastic cord having a plug at each end. The plugs generally have a conical taper resulting in an inward facing conical bulge at each end of the cord 140, as is well known in the art. Alternatively, the plugs may have a spherical bulge instead of a conical bulge. In use, to attach one end of the cord 140 to the handle 20, the gate 24 is pushed up from the closed position shown in FIG. 1 to the open position shown in FIGS. 2-4. The gate arms 76 slide within the gate slots 44. In the full open position a surface on the gate 24 bottoms out on a stop 55 in the base section 42, preventing the gate from sliding all the way out and separating from the handle frame 22. With the gate 24 in the open position, the cord channels 54 are open and accessible. Either end of the cord may then be threaded through a cord channel. With the gate open, there is sufficient clearance to move the plugged end of the cord through the channel. The same procedure is then used to attach the other end of the cord to a second handle, to form an elastic resistance cord training system or device. With the handle 20 shown in FIGS. 1-6, one, two or three cords 140 may be used.

After the cords are threaded through or into the channels 54, the gate 24 is pushed down and returned to the closed position. The shoulders 94 on the gate move into position over the dividers 58, as shown in FIG. 5. The grooves 92 on the inside surface of the gate 24, together with the surfaces 52 on the base section 42, may form a conically tapering holder around the bulge at the end of the cord. The cord 140 therefore cannot pull free from the handle, even under high force. The tension forces on the cord are distributed over the surfaces 52, 62 and 92, reducing the stress on the cord and on the handle. A similar result may be obtained using cords having a spherical bulge that fits within a corresponding spherical socket in the handle. It is also possible secure the ends of the cord in a handle without a tapering holder or socket. In this case a simple wall or lip 108, as shown in FIG. 10, reduces the opening in the handle through which the cord passes to a size smaller than the bulge in the cord, regardless of the shape of the bulge.

When the cord is in use and under tension, the pulling force acts to hold the gate in the closed position. The lower edge 50 of the gate bottoms out on a gate stop 55 on the base section 42 shown in FIGS. 2 and 5, preventing the gate from pulling out of the handle frame 22. With the gate in the closed position, the detent block 47 projects into the block opening 86 on each side of the gate 24. This provides a holding force on the gate, whenever the gate is in the closed position.

The handles 20, 100 or 120 may be provided along with a selection of cords having varying spring constants and/or lengths, in the form of a kit. An elastic resistance cord training system may include two of the same handles, two different handles, or an assortment of handles, and one or more cords attachable to each of the types of handles. The training system may be used to train and condition the user's arms via the user grasping one handle in each hand and then pulling outwardly to stretch the cord, as is well know in the art. Other body sections may be similarly trained or conditioned by placing one handle under or onto a foot and pulling the other handle with a hand, as is also well known in the art.

The designs shown FIGS. 7-12 operate in the same way as described above. The gates allow the cords 140 to be quickly and easily removed from the handles, and replaced with different cords having different lengths or elastic characteristics. At the same time, the handles also securely attach to the ends of the cords, to prevent the cord from inadvertently separating from the handle when in use.

Figure 15:
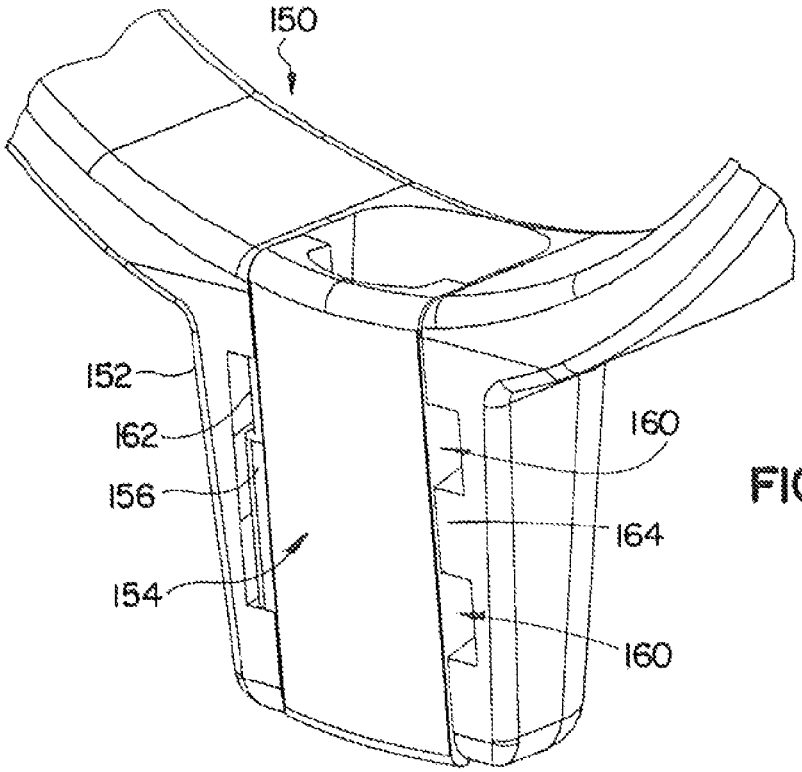
FIG. 15 is a perspective of a fourth embodiment with a gate in a closed position.

FIGS. 15-19 show a fourth embodiment 150 having a pivoting gate 154 on a handle frame 152 instead of a sliding gate. The gate 154 is pivotally attached to the frame 152 via a pin 162 in the frame passing through hinge tab 156 on a first or left side of the gate 154. One or more lugs 158 are provided on a second or right side of the gate 154. The vertical spacing between the lugs 158 matches the vertical spacing between lug slots 160 in the front wall 164 of the frame 152. FIG. 15 shows the handle 150 in a closed and locked position. In this position, a cord 140 may be securely attached to the handle 150. In the closed and locked position, the gate is held closed. The left side of the gate is held onto the frame via the pin 162 extending through the hinge tab 156 on the gate. The right side of the gate is held into engagement with the frame via the lugs 158 positioned behind the front wall 164 of the frame.

Figure 16:
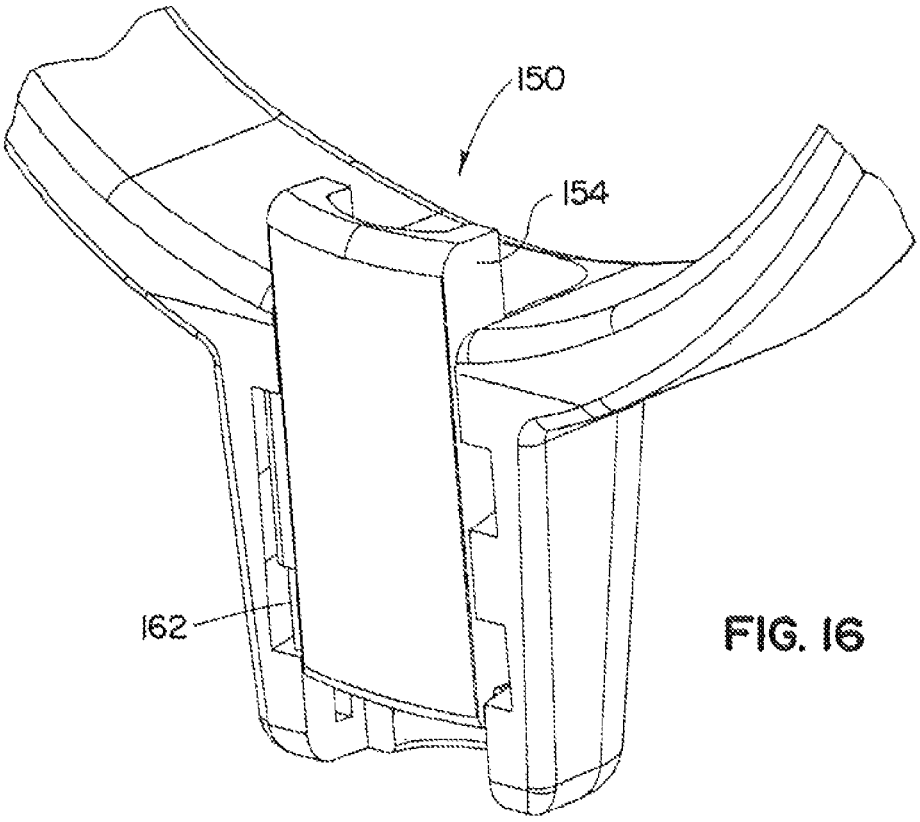
FIG. 16 is a perspective view of the handle of FIG. 15 with the gate in an up position.
Figure 17:
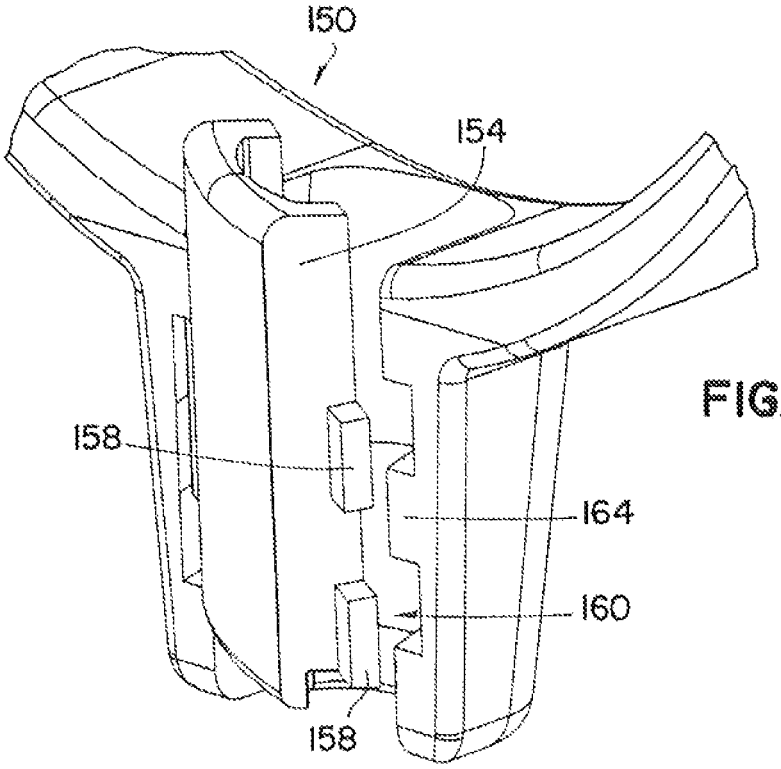
FIG. 17 is a perspective view of the handle of FIG. 15 with the gate in a partially open position.
Figure 18:
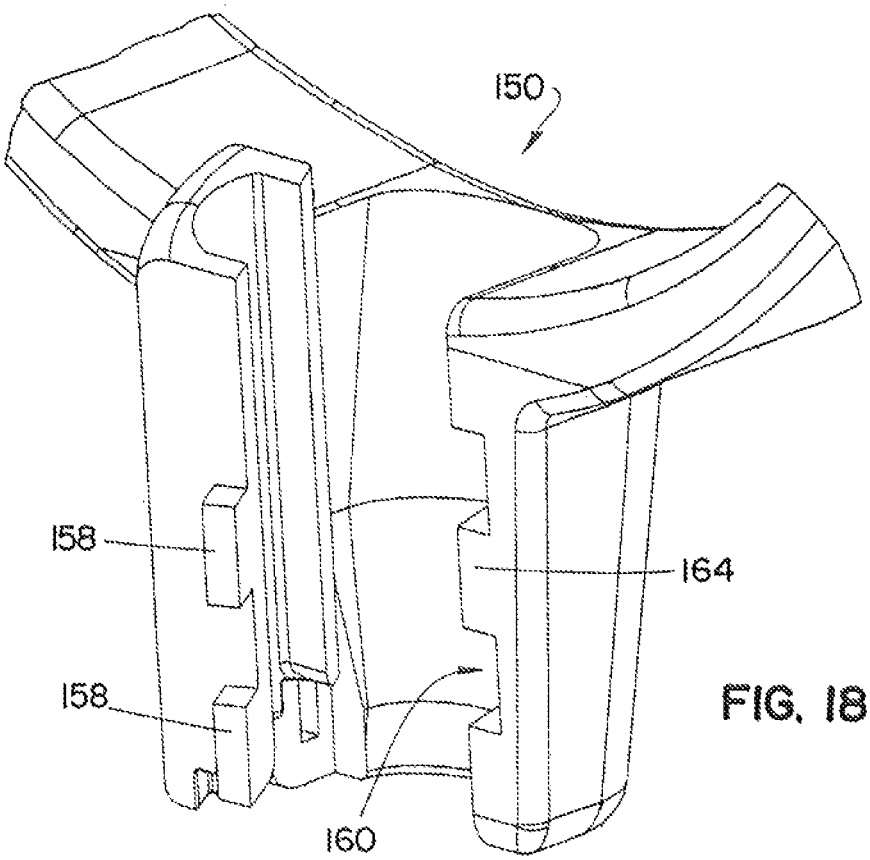
FIG. 18 is a perspective view of the handle of FIG. 15 with the gate in a full open position.
Figure 19:
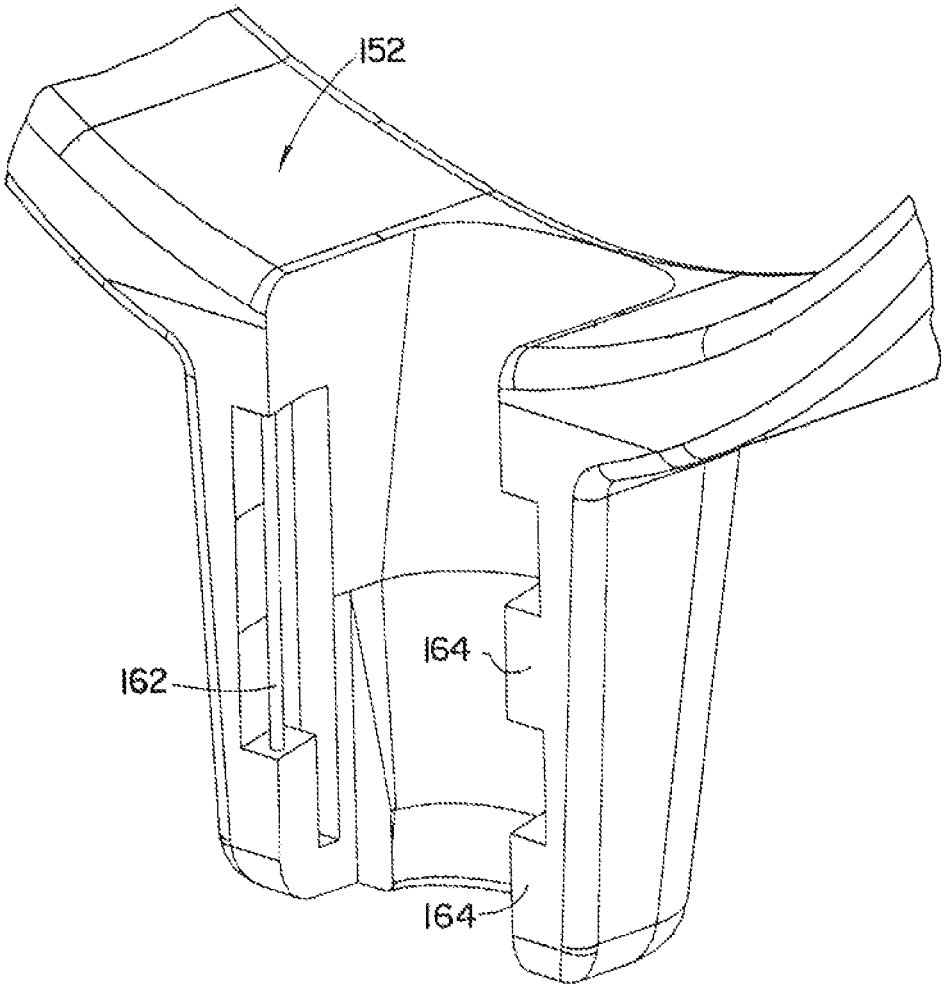
FIG. 19 is a perspective view of the handle of FIG. 15 with the gate removed for purpose of illustration.

To release the handle 150 from a cord, the gate is first pushed into the up position shown in FIG. 16. This aligns the lugs 158 with the lug slots 160. The gate 154 may then be pulled open, as shown in FIGS. 17 and 18. With the gate 154 open, the cord may be removed and replaced. Although FIGS. 15-18 show a handle with a single cord channel, multiple cord channels may also be used with a handle having a pivoting gate.

In each of the designs described, the minimum diameter (or characteristic largest dimension) of the cord channels is larger than the cord diameter. This allows the cord to be positioned into the channel without deforming or compressing the cord or the handle frame. The channels formed in the handle frames are generally semi-circular, subtending an arc of about 180 degrees, or less. The grooves 92 on the underside of the gate, if used, may also be generally semi-circular, with the grooves typical subtending an arc of 120 degrees, or less.

Figure 20:
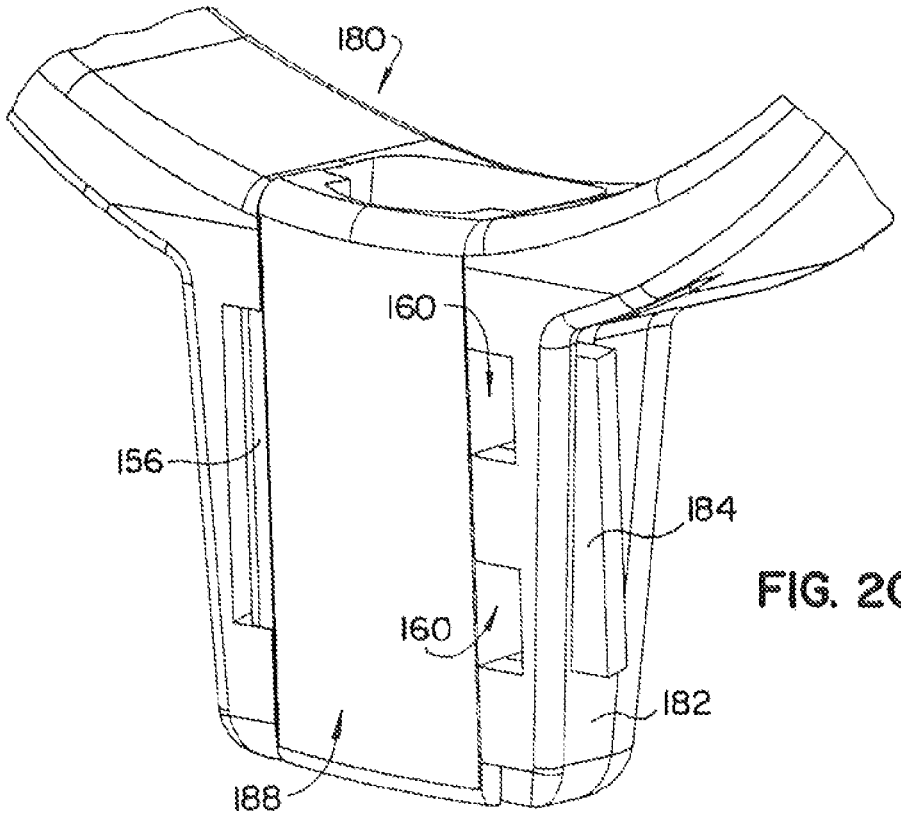
FIG. 20 is a perspective of a fifth embodiment with a gate in a closed and locked position.
Figure 21:
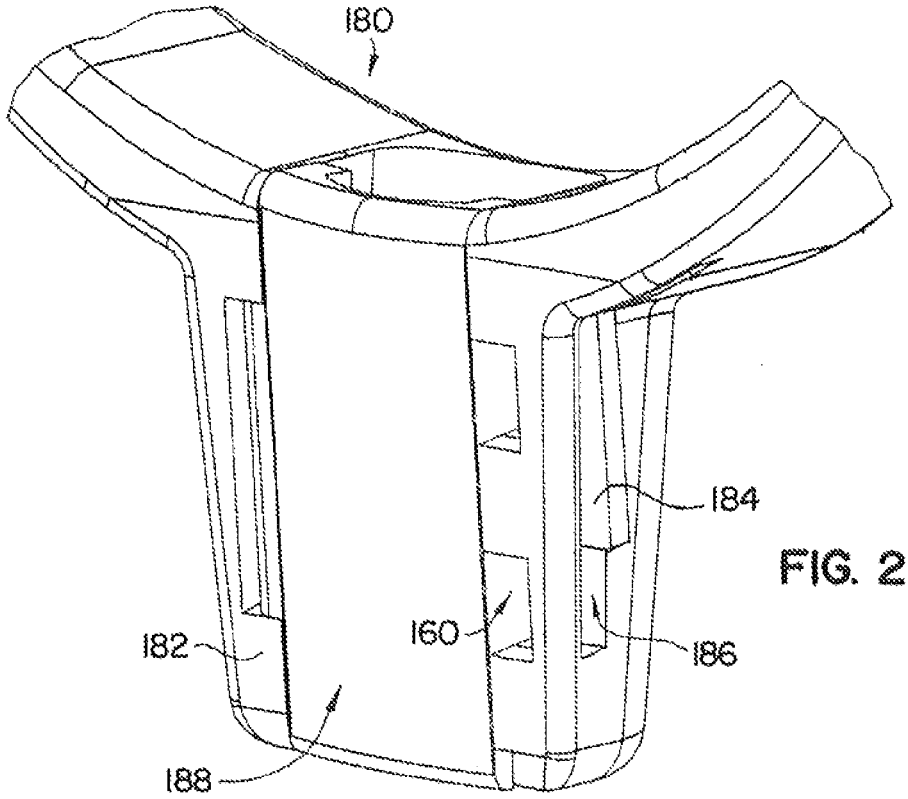
FIG. 21 is a perspective view of the handle of FIG. 20 with the gate in a closed and unlocked position.
Figure 22:
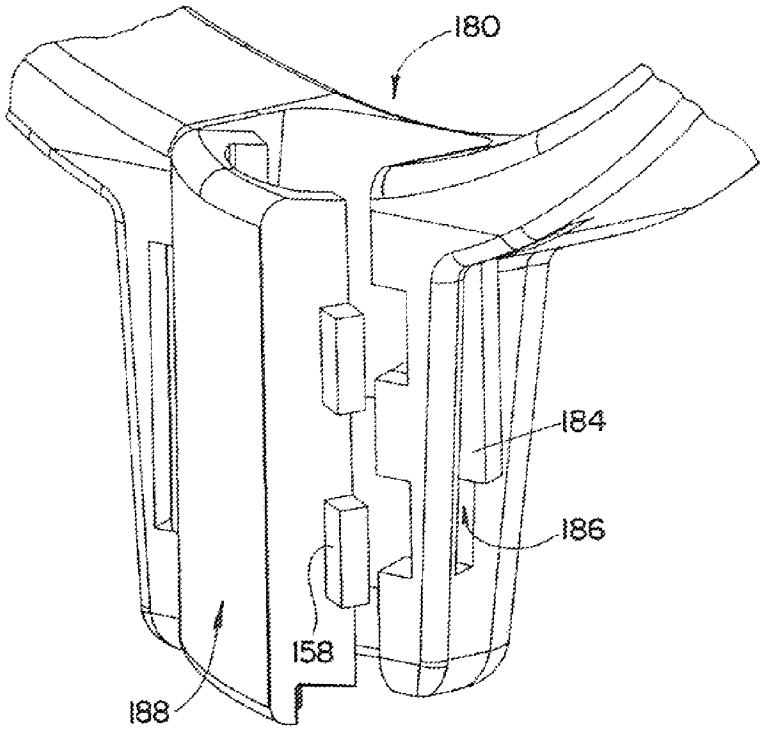
FIG. 22 is a perspective view of the handle of FIG. 20 with the gate in a partially open position.

FIGS. 20-22 show another handle 180 also having a pivoting gate 188 attached to a handle frame 182 via a pin 162. A slide lock 184 is movable vertically within a lock slot 186 in the frame 182. In this design, in the closed and locked position shown in FIG. 20, the slide lock is in front of the lugs 158, preventing the gate from opening. FIG. 21 shows the slide lock pushed up into an unlocked position, where cutouts in the slide lock 184 are aligned with the lug slots 160 in the front wall 164 of the frame 182. The gate 188 is then free to pivot open, as shown in FIG. 22. Unlike with the handle 150 shown in FIGS. 15-19, in the handle 180 show in FIGS. 20-22, the vertical position of the gate 188 is fixed, and the gate 188 does not move vertically into the up position.

Figure 23:
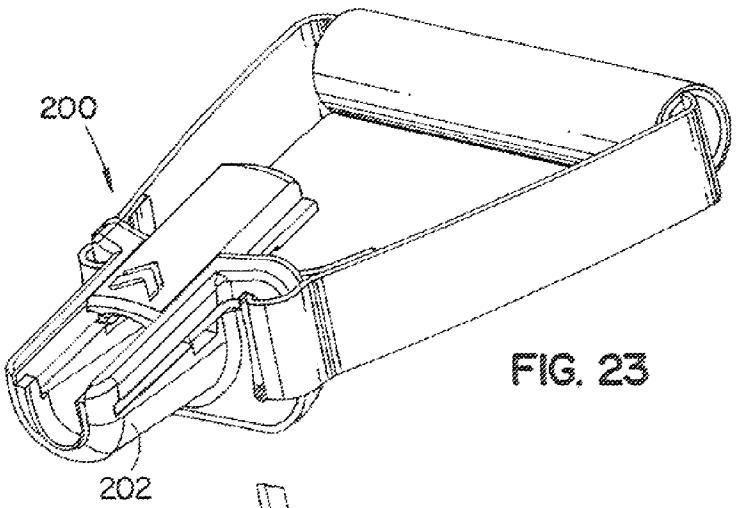
FIG. 23 is a perspective view of a sixth embodiment.
Figure 24:
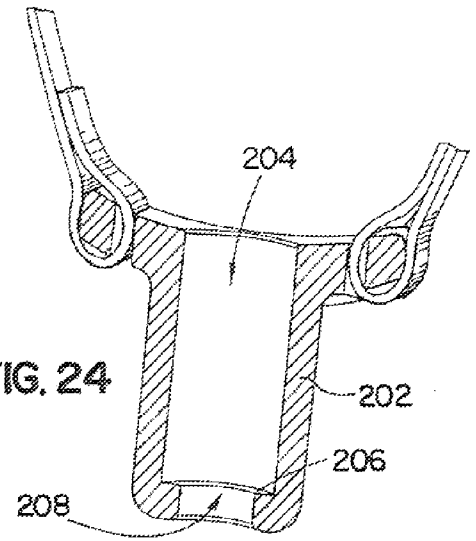
FIG. 24 is a section view of the frame of the handle shown in FIG. 23.

FIGS. 23-24 show a design 200 similar to the handle frame 120 shown in FIGS. 9-12. However, the frame 202 of the handle 200 has a cylindrical opening 204, or cylindrical sidewalls, for holding a cord, and a cord clearance opening 208 in the bottom wall of the frame. The cords 140 may have conically tapered plugs or spherical plugs.

Figure 25:
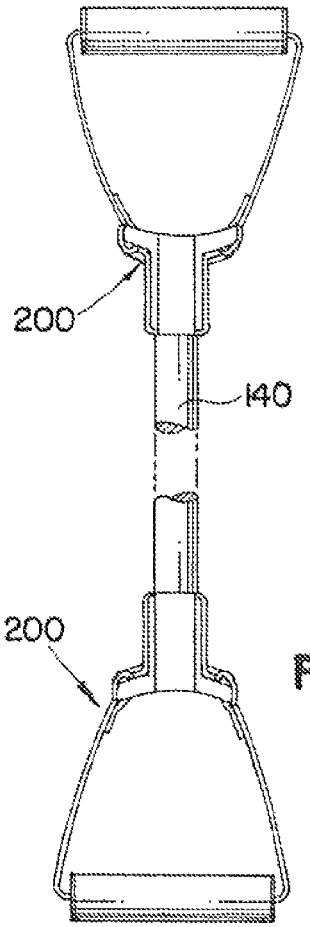
FIG. 25 is a front view of elastic cord training system made up of two of the handles shown in FIG. 23 and a single elastic cord with the ends of the cord secured into the handles.

The handle 200 may be preferred for use with cords having spherical plugs. FIG. 25 shows an elastic cord training system made up of two of the handles shown in FIG. 23 and a single elastic cord with the ends of the cord secured into the handles. Similar systems may be made up using the other handles described above, with one or more elastic cords.

Figure 26:
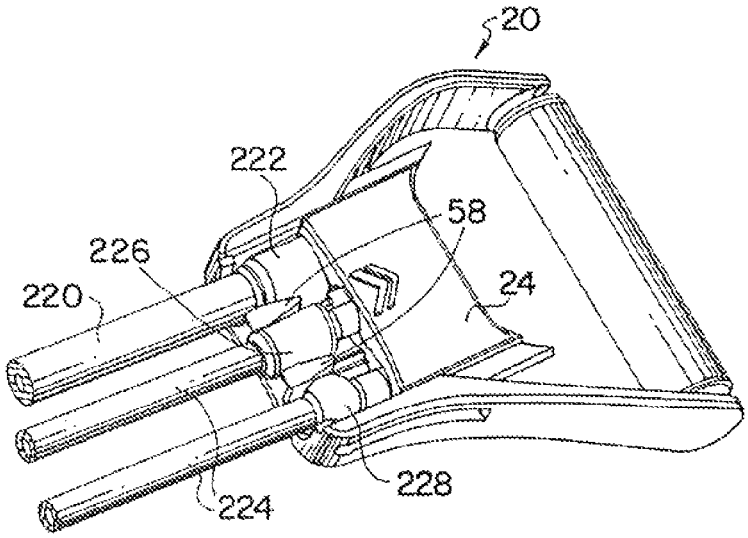
FIG. 26 is a perspective view of the handle shown in FIGS. 1-6 holding three different types of elastic cord, and with the gate in the open position, for purpose of illustration.
Figure 27:
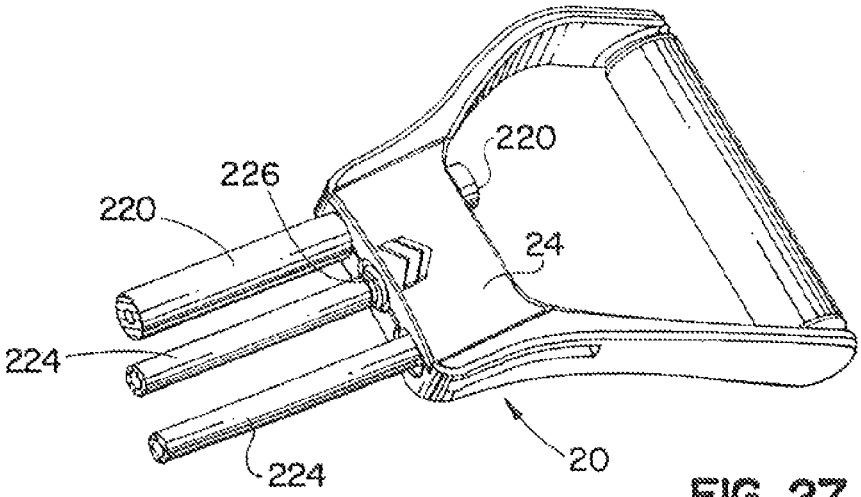
FIG. 27 is a perspective view of the handle of FIG. 26 with the gate in the closed position.

FIGS. 26 and 27 show various cord designs that may be used with the handles described above. As shown in FIG. 26, the diameter and the wall thickness of the elastic cord material may be varied to change the spring constant or resistance of the cord. Different plug designs may also be used. In FIG. 26, a thick cord 220 having a cone plug is in the first or top cord position. A smaller diameter cord 224, which may also have a thinner wall, is provided with a smaller diameter cone plug, at the second or center cord position. The same cord 224 is shown in the third cord position with a ball or sphere plug. Typically, a pair of handles would be connected to one or more of the same type of cord and plug. FIG. 26 shows a mix of cords and plugs for purpose of illustration. The plugs are inserted inside of the cords are not visible. FIG. 26 shows the outline of cords with the plugs installed. The handles may of course also be used with other types of cords having other plug or end fitting designs, including cords that may simply have knotted ends.

As shown in FIGS. 26 and 27, the larger diameter plug 222 projects above the dividers 58, and the end of the cord may project above the gate 24. The smaller diameter plug 226 may fit substantially within or entirely between the dividers. The ball plug 228 fits within the dividers.

Thus, novel handles and elastic resistance cord training systems have been shown and described. Various changes and modifications may of course be made without departing from the spirit and scope of the invention. The invention, therefore, should not be limited, except by the following claims and their equivalents.

The invention claimed is:

1. A handle for an elastic cord resistance exercise device, comprising:

a handle frame;

a grip on the handle frame adjacent to a first end of the handle frame;

a base on the handle frame adjacent to a second end of the handle frame, with the base having a base inner surface;

a gate having a gate inner surface, with the gate movable on the handle frame from an open position where the gate inner surface is substantially longitudinally offset from the base inner surface, to a closed position wherein the gate inner surface is substantially aligned with the base inner surface to form a cord channel which tapers towards the base from the grip.

2. The handle of claim 1 with the gate having left and right side arms extending into left and right side gate slots in the handle frame, and wherein the gate is slidable on the handle frame from the open position into the closed position.

3. The handle of claim 1 further comprising a cord groove on an inside surface of the gate.

4. The handle of claim 1 with the gate permanently attached onto the handle and slidable between the open and closed positions in a direction substantially parallel to a central axis of the cord channel.

5. The handle of claim 1 wherein the cord channel has a frustro-conical section.

6. The handle of claim 1 further comprising an open top at a first end of the cord channel and a lip at a second end of the cord channel.

7. The handle of claim 1 with the gate inner surface and the base inner surface forming a tapering cord channel between them, when the gate is in the closed position.

8. The handle of claim 1 with the gate slidable between the open and closed positions in a direction perpendicular to a central axis of the grip.

9. A handle for an elastic cord resistance exercise device, comprising:

a handle frame;

a grip on the handle frame adjacent to a first end of the handle frame;

a base on the handle frame adjacent to a second end of the handle frame, with the base having a base inner surface;

a gate having a gate inner surface, with the gate movable on the handle frame from an open position wherein the gate inner surface is longitudinally offset from the base inner surface, to a closed position wherein the gate inner surface is aligned with the base inner surface to form a cord channel which tapers towards the base from the grip.

10. A handle for an elastic cord resistance exercise device, comprising:

a handle frame;

a grip on the handle frame adjacent to a first end of the handle frame;

a base on the handle frame adjacent to a second end of the handle frame, with the base having a base inner surface;

a gate having a gate inner surface, with the gate movable on the handle frame from an open position wherein the gate inner surface is longitudinally offset from the base inner surface, to a closed position wherein the gate inner surface is aligned with the base inner surface to form a cord channel which tapers towards the base from the grip;

with the gate permanently attached onto the handle and slidable between the open and closed positions in a direction substantially parallel to a central axis of the cord channel.

* * * * *